US012797665B2

(12) United States Patent
Koehler

(10) Patent No.: US 12,797,665 B2
(45) Date of Patent: Nov. 17, 2026

(54) SCAFFOLDING SYSTEM COMPRISING INCLINED POSTS AND SPHERICAL CLAMPS

(71) Applicant: BERLINER SEILFABRIK GMBH & CO., Berlin (DE)

(72) Inventor: Karl-Heinz Koehler, Berlin (DE)

(73) Assignee: BERLINER SEILFABRIK GMBH & CO., Berlin (DE)

( * ) Notice: Subject to any disclaimer, the term of this patent is extended or adjusted under 35 U.S.C. 154(b) by 106 days.

(21) Appl. No.: 18/683,368

(22) PCT Filed: Sep. 12, 2022

(86) PCT No.: PCT/EP2022/075265
§ 371 (c)(1),
(2) Date: Feb. 13, 2024

(87) PCT Pub. No.: WO2023/041479
PCT Pub. Date: Mar. 23, 2023

(65) Prior Publication Data

US 2025/0135258 A1 May 1, 2025

Related U.S. Application Data

(60) Provisional application No. 63/245,355, filed on Sep. 17, 2021.

(30) Foreign Application Priority Data

Sep. 17, 2021 (DE) ..... 10 2021 124 119.7

(51) Int. Cl.
*A63B 9/00* (2006.01)
*A63B 17/04* (2006.01)

(52) U.S. Cl.
CPC ..... *A63B 9/00* (2013.01); *A63B 17/04* (2013.01); *A63B 2009/006* (2013.01)

(58) Field of Classification Search
CPC ..... A63B 9/00; A63B 17/04; A63B 2009/006; E04B 2001/1927; E04B 2001/1951;
(Continued)

(56) References Cited

U.S. PATENT DOCUMENTS 4,974,986 A * 12/1990 Cook ..... F16B 7/04 403/171
5,626,434 A * 5/1997 Cook ..... E04B 1/1903 403/171
(Continued)

FOREIGN PATENT DOCUMENTS

DE 87 121 119 U1 10/1987
FR 2513736 A 4/1983
(Continued)

OTHER PUBLICATIONS

International Search Report, dated Dec. 20, 2022, in connection with International Search Report No. PCP/EP2022/075265.
(Continued)

*Primary Examiner* — Megan Anderson
*Assistant Examiner* — Kathleen M Fisk
(74) *Attorney, Agent, or Firm* — Norris McLaughlin, PA

(57) ABSTRACT

The invention relates to a scaffolding system (10) with posts (20) and spherical clamps (25), in which one or more posts (10) are arranged at an angle. The spherical clamps (25) are formed from two hemispheres (30) each having at least two elements (30A, 30B), each of which surrounds the post (20). The equatorial surfaces (32) of the hemispheres (30), which are formed by the respective at least two elements (30A, 30B), deviate at the angle (α) from a plane perpendicular to an inclined post (20), at which this same post (20) is inclined. As a result, the equatorial surfaces (32) are aligned horizontally. Furthermore, the hemispheres (30) of the clamps (25) have receptacles (40) for the insertion of attachment parts (60).

11 Claims, 10 Drawing Sheets

Figure 1:
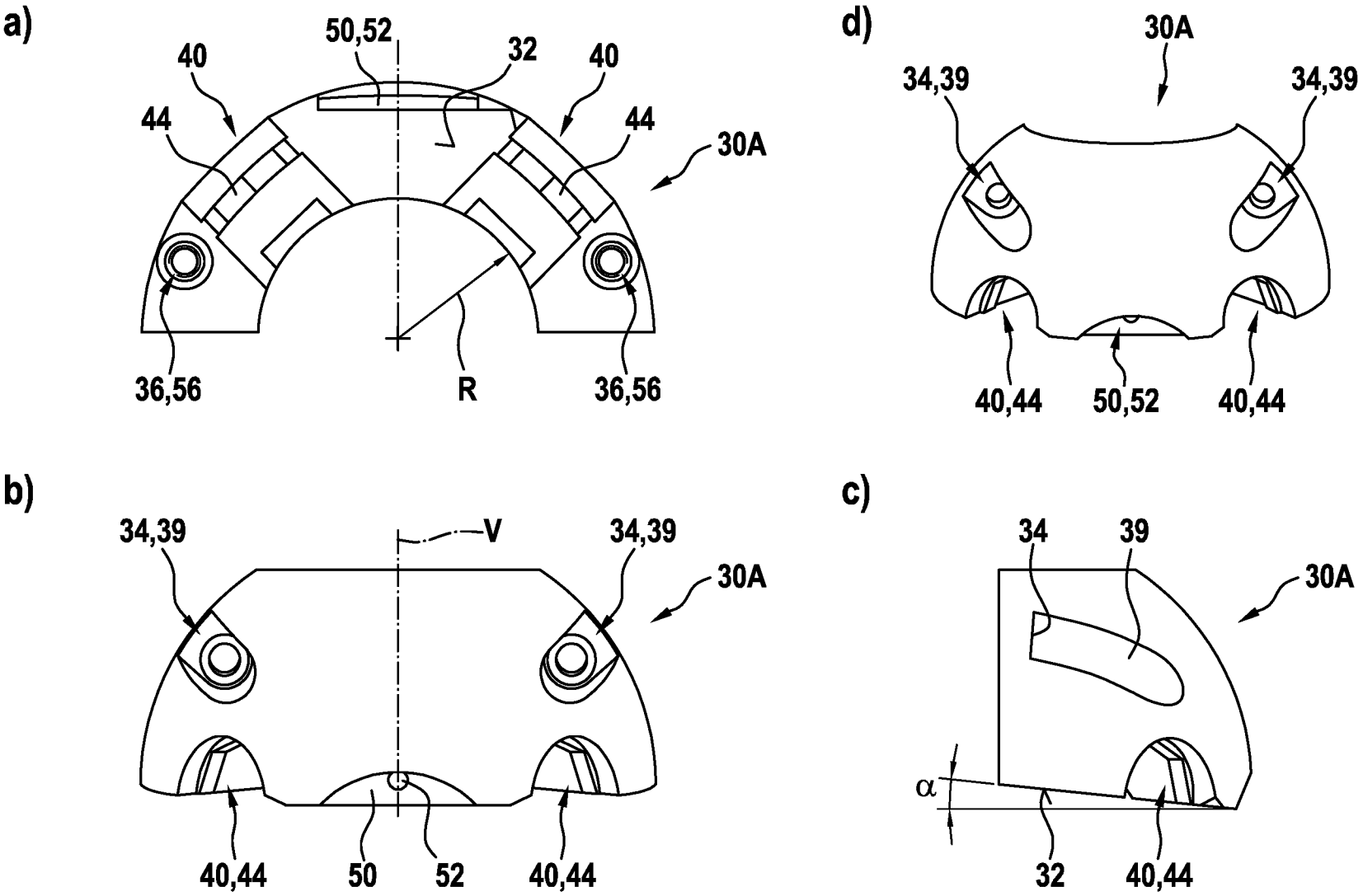

(58) Field of Classification Search
CPC ..... E04B 2001/1963; E04B 2001/5875; E04B 1/1906; E04B 1/585; E04B 1/5843; E04G 7/20; E04G 7/22; E04G 7/24; E04G 1/06
See application file for complete search history.

(56) References Cited

U.S. PATENT DOCUMENTS

| | | | | |
|---|---|---|---|---|
| 8,366,562 | B2 * | 2/2013 | King | A63B 17/00 472/136 |
| 9,089,731 | B2 * | 7/2015 | King | A63B 9/00 |
| 2002/0118998 | A1 * | 8/2002 | Boxenbaum | E04B 1/585 403/141 |
| 2006/0128530 | A1 * | 6/2006 | Gillett | A63B 9/00 482/35 |

FOREIGN PATENT DOCUMENTS

| | | | | |
|---|---|---|---|---|
| FR | 2513736 | A1 * | 4/1983 | E04B 1/1906 |
| GB | 271 709 | A | 6/1927 | |
| WO | 97/07342 | A1 | 6/1927 | |
| WO | 02/076565 | A1 | 10/2002 | |

OTHER PUBLICATIONS

English translation of International Search Report, dated Dec. 20, 2022, in connection with International Search Report No. PCT/EP2022/075265.
Written Opinion in in connection with International Search Report No. PCT/EP2022/075265.

* cited by examiner a)

b)

a)

b)

SCAFFOLDING SYSTEM COMPRISING INCLINED POSTS AND SPHERICAL CLAMPS

This application is the U.S. National Stage of International Application No. PCT/EP2022/075265, filed Sep. 12, 2022, which claims foreign priority benefit under 35 U.S.C. § 119 of German Patent Application No. 10 2021 124 119.7, filed Sep. 17, 2021, and U.S. Provisional Application No. 63/245,355, filed Sep. 17, 2021, the disclosures of which are incorporated herein by reference.

The invention relates to a scaffolding system with posts and spherical clamps, in which one or more posts are arranged at an angle. The spherical clamps are formed from two hemispheres each having at least two elements, each of which surrounds the post. The equatorial surfaces of the hemispheres, which are formed by the respective at least two elements, deviate at the angle from a plane perpendicular to an inclined post, at which this same post is inclined. As a result, the equatorial surfaces are aligned horizontally. Furthermore, the hemispheres of the clamps have receptacles for the insertion of attachment parts (60).

Playground installations and climbing frames are often assembled from system parts. The design solutions that can be realised are therefore limited. They often also require a vertical and horizontal alignment of built-in parts such as posts and attached attachment parts, which are aligned at right angles to each other as a result of the use of system parts. However, such an arrangement is perceived as less creative and stimulating for playing children and also as less organic, especially if the playground installations and climbing frames are intended to imitate familiar objects or figures, such as a pirate ship. If the arrangement of individual components is to deviate from the rectangular grid, special solutions are usually required, which are complex and therefore cost-intensive.

It would be desirable if components for the design of playground installations and climbing frames could be designed more flexibly and, in particular, if it were possible to deviate from the purely vertical and horizontal alignment of the components without having to resort to customised special solutions every time. In order to make this possible, solutions are needed that allow the individual components to be connected and attached to each other at different angles.

The problem of the invention is therefore seen in designing such junctions in such a way that an inclined arrangement of components is possible.

The problem of the invention is solved by a scaffolding system as disclosed herein and a use of the scaffolding system as disclosed herein. Further preferred embodiments of the invention result from the other features mentioned in the subclaims.

A scaffolding system according to the invention is formed with posts and spherical clamps, wherein at least one post is arranged inclined at an angle, respectively, and at least one spherical clamp is arranged on an inclined post, respectively, and wherein a spherical clamp in each case.

- is composed of two hemispheres and wherein each of the two hemispheres is formed from the same at least two elements, which differ from one another within one hemisphere,
- the at least two elements of each hemisphere surround the post,
- the equatorial surfaces formed by the at least two elements of a hemisphere deviate from a plane perpendicular to the associated post at the angle at which this post (20) is inclined in order to align these equatorial surfaces horizontally,
- the at least two elements of a hemisphere are screwed together so that a clamping effect results between the hemisphere and the associated post,
- the hemispheres are screwed together, and
- the elements have receptacles in the region of the equatorial surfaces of the hemispheres for the insertion of at least one attachment part.

The scaffolding system therefore has posts and spherical clamps, which are combined in the number required for the scaffolding or the application. A post is understood to be a load-bearing component with a predominantly longitudinal extension that is vertically aligned or whose alignment is mainly vertical. At least one of these posts is inclined at an angle to the vertical. In particular, a post can be tubular or hollow.

At least one spherical clamp is arranged on an inclined post. This spherical clamp is formed from two composite hemispheres, which in turn are each composed of at least two elements. Within a hemisphere, the elements differ due to the inclination of the equatorial surface to be formed and possibly the design of the screw connections or other optional designs, as will be shown, but the hemispheres are identical to each other in their construction. They therefore consist of elements identical in their construction. The hemispheres each form an upper and a lower hemisphere and are arranged on top of each other in such a way that they form a spherical shape.

The term hemispheres is not to be understood as a hemisphere in the geometrically correct sense.

Rather, the groupings of at least two elements correspond approximately to a hemisphere. They therefore have the appearance of a hemisphere, but deviate from a hemispherical shape in the geometric sense due to the inclined equatorial surface, which will be explained later. After assembling the hemispheres, which will be explained below, the spherical clamp has the appearance of a sphere.

The at least two elements of each hemisphere surround the post. They are therefore shaped and arranged in such a way that they enclose the post when installed. For this purpose, the elements of the respective hemispheres each have a shape in sections that corresponds to the outer contour of the post, so that the elements of the hemispheres rest against the post in this region.

The at least two elements of each hemisphere form an equatorial surface. This refers to the circular base surface of the respective hemisphere. However, according to the invention, this equatorial surface does not extend in a plane which is aligned perpendicular to the inclined post. Instead, it deviates from the plane perpendicular to it by the angle at which the post is inclined. As a result, it is aligned horizontally when installed, i.e. it is essentially horizontal within the manufacturing and installation tolerances.

This is made possible by the design of the elements of the hemispheres. The surfaces of the at least two elements aligned in the direction of the equatorial surface realise the desired inclination. These surfaces are not designed perpendicular to a vertical axis of the respective hemisphere, but are inclined by the angle in question. This is done in such a way that the adjacent elements of a hemisphere each continue the inclination of the surfaces of the adjacent elements facing the equatorial surface and a common equatorial upper plane is formed as soon as they are assembled.

The two hemispheres are then placed on top of each other during assembly so that a closed spherical clamp is formed.

The hemispheres are rotated against each other, regardless of the actual assembly, so that the inclination of the equatorial surfaces of the two hemispheres allows the upper equatorial surface to rest flush on the lower equatorial surface. The attachment to the inclined post ensures that the equatorial surface is essentially horizontal.

The elements of each hemisphere are screwed together, i.e. connected to each other by means of screws. In addition to connecting the elements within a hemisphere, a clamping effect is also achieved between the at least two elements of a hemisphere and the inclined post, so that the spherical clamp is prevented from slipping along the inclined post.

In addition, the two hemispheres are screwed together to secure their relative position to each other.

At least two screws are preferably provided for the screw connections. These are screwed through corresponding screw holes in one of the at least two elements of a hemisphere into corresponding threaded bushes in an adjacent element within the hemisphere if the elements of a hemisphere are to be screwed together.

If both hemispheres are screwed together, the screw holes are each provided in at least one element of one hemisphere and threaded bushes are provided in the at least one element of the other hemisphere, which is arranged adjacent to it when the spherical clamp is assembled.

In the example of a spherical clamp with two elements in each hemisphere, respectively, eight screws are used, namely two per hemisphere to screw the elements of the hemispheres together and a further two to screw an element of the upper hemisphere to an element of the lower hemisphere.

Finally, the elements of the hemispheres have receptacles in the region of the equatorial surfaces into which at least one attachment part can be inserted. These are recesses in the elements of the hemispheres into which attachment parts or their ends can be inserted or arranged. Attachment parts are also elements of the scaffolding system. In particular, the recesses are designed in such a way that half of them are arranged in an element of the lower hemisphere and half in an adjacent element of the upper hemisphere, wherein these half recesses correspond to each other in position and size and enclose an inserted attachment part or its end after assembly.

The essential inventive concept of the scaffolding system according to the invention is that the elements of the two hemispheres are identical. The upper hemisphere and the lower hemisphere are therefore identical. The inclination in the region of the equatorial surfaces, the screw holes and threaded bushes for screwing the hemispheres together and the receptacles for attachment parts are designed, arranged and aligned in such a way that the hemispheres can be easily assembled and connected to each other.

The assembly is described using the example of the spherical clamp with two elements per hemisphere: Each hemisphere of this example is formed with one element A and one element B. Firstly, element A and element B of the lower hemisphere are positioned on the inclined post and screwed together. Attachment parts can then be inserted into the receptacles provided for this purpose. Next, element B of the upper hemisphere is placed on element A of the lower hemisphere and screwed together, then element A of the upper hemisphere is placed on element B of the lower hemisphere. Then elements A and B of the upper hemisphere are screwed together and element A of the upper hemisphere is screwed to element B of the lower hemisphere. It is advisable to only insert the attachment part(s) into the designated receptacles, the elements of which are immediately screwed together to prevent them from falling down until the corresponding element of the upper hemisphere is fitted.

As can be seen above, the upper hemisphere is offset from the lower hemisphere, so that an element B sits above an element A and an element A above an element B. This results from the assembly of the elements A and B within the hemispheres and the overall inclination of the equatorial surface formed there, which is made up of the inclined partial surfaces of the individual elements in the region of the equatorial surface. By offsetting the hemispheres in relation to each other in the sense of a rotation around a vertical axis, the equatorial inclinations of the upper and lower hemispheres are aligned with each other, resulting in a closed spherical shape.

Due to the identical design of the upper and lower hemispheres with their individual elements, standardised elements can be provided and used for the hemispheres, which are always arranged and connected to each other in the same way. As the individual elements are only assembled when they are attached to the inclined post, they do not have to be laboriously pushed over the post until they reach the desired position.

The skilled person will recognise that a similar spherical clamp can also be formed without an inclination. The scaffolding system can be formed with further posts and spherical clamps, which can be formed and arranged with other inclination angles and/or without inclination.

With the scaffolding system according to the invention, it is therefore possible to install inclined posts but always provide the connections for attachment parts of all kinds in a horizontal alignment. The inclined arrangement of posts allows playground installations and climbing frames to be designed in a more organic and pleasing way and with greater creative freedom.

In a first embodiment of the invention, it is provided that the at least one post has a round cross-section and the hemispheres of the at least one clamp arranged on it each surround the post in a ring shape. If the post is formed with a round cross-section, it has no edges or corners on which a user of the scaffolding system can bump and injure himself. It also creates a more pleasing appearance in terms of design. The spherical clamp, which is arranged on such a round, inclined post, surrounds it in a ring shape. The elements of the hemispheres are formed with circular arc sections on the surfaces facing the post in relation to a plan view, which form a circle after assembly that corresponds to the diameter of the round post. In spatial terms, the inner surfaces form a cylinder through which the post runs.

In a second embodiment of the scaffolding system, a post is arranged at an angle in the range of 2° (degrees) to 12° (degrees), in particular inclined by essentially 5°. An inclination in the range of 2° to 12° is already perceived by the observer's eye as an inclination and deviation from the vertical and allows more varied designs of playground installations and climbing scaffolding. Larger angles of inclination already place higher demands on the stableness and stability of the scaffolding system.

According to another embodiment of the scaffolding system, the at least two elements of one hemisphere have different colours. The colours should preferably be recognisably different. The respective colour is used to identify the individual elements. All elements of one type therefore have the same colour. Thanks to the different colours, it is possible to easily and reliably distinguish during assembly which elements are to be assembled and which element still needs to be added for complete assembly without having to search for printed or embossed markings and/or measure the elements. Accordingly, assembly can also be carried out using a simple coloured picture template. The colouring of the upper and lower hemispheres is the same, as the same elements are used in both hemispheres.

Various attachment parts can be provided for the scaffolding system. An attachment part is selected from the group of a tube, a handle, a decorative element, a sunshade, a rope, a closure plug. An attachment part can be designed in such a way that it is fixed in the spherical clamp by means of a receptacle, but also by means of several receptacles in the same spherical clamp. Some attachment parts only have one fixing point on a clamp, others are mounted on several clamps and thus fixed.

A tube as an elongated hollow body can be used, for example, as a horizontal connection between two spherical clamps on two posts, especially inclined posts. It can thus form a fall protection device, but also a fastening option for panelling, decorations and other attachment parts that are not designed for fastening to a spherical clamp. A tube can only have one longitudinal extension, i.e. be designed as a straight tube, but it can also be used in curved shapes.

A handle is an attachment part that is used to provide support for users of the scaffolding system or to facilitate entry or ascent. A handle can, for example, be a curved element between two spherical clamps.

Decorative elements are very diverse. They include panelling, but also ladders, climbing poles or other climbing and access aids in the scaffolding system. Elements for sun shade can also be attached to the receptacles of the spherical clamps and extend over regions of the scaffolding, for example as an awning, so that users are protected from direct sunlight.

Ropes are additional elements that can be attached to a spherical clamp or run between spherical clamps. These can be used as fall protection, but also for climbing and playing.

In cases where a receptacle of the spherical clamp is not used, it can be closed with a closure plug. A closure plug should be understood as a moulded part that closes the receptacle to the outside so that no dirt or water can penetrate and nobody can reach into the opening formed by a receptacle and injure themselves.

In one embodiment of the scaffolding system, the receptacles for attachment parts are each offset by 90° (degrees) along the equatorial surfaces. A total of four receptacles can therefore be distributed along an equatorial surface, which are evenly distributed along the circular base surface. This means that attachment parts can be inserted in four main directions from the spherical clamp and therefore the post. If a hemisphere is formed with two elements, as described above by way of example, and if these are the same size, two receptacles would be formed for each element. Such a regular arrangement allows loads that are entered into the attachment parts and thus the spherical clamp via attachment parts to be evenly distributed and absorbed.

A further embodiment of the scaffolding system is that an attachment part is formed with a profiling in the region that is inserted into a receptacle of the spherical clamp and the receptacles of the spherical clamp are formed with a corresponding profiling in order to realise a form fit between the attachment part and the receptacle(s).

A profiling in the end region or support region of an attachment part should be understood as a specially moulded outer shape of this region, which is designed and formed by a curve, a radius, projections and recesses, edges and the like in such a way that it engages with a corresponding surface profile in a receptacle and thus prevents twisting and/or slipping in the receptacle. It is preferably embossed so that the attachment part has a smaller cross-section in this region. The profiling of the attachment part and the corresponding profiling of the receptacle can also be used to specify an alignment of the attachment part, which makes installation easier.

In particular, the profiling can be a circumferential octagonal profiling of the attachment part in the region of the support in the spherical clamp. This can be illustrated using the example of a tube as an attachment part: In the end region of the tube, which is inserted into the spherical clamp, there is an octagonal contour in some regions, which can be formed using a radial jaw press, for example. This is formed circumferentially at the end region of the tube like an embossed ring. The receptacles in the elements of the spherical clamp each have elevations that correspond to the depressions of this exemplary octagonal profiling. When the attachment part is inserted into the receptacle, the profilings in the end region of the attachment part and those of the receptacle come into contact and thus form a form fit.

Preferably, the profiling of the attachment part is not formed right up to its end, but a section without profiling remains there. This allows the attachment part to be secured against pulling out or slipping out of the receptacle, as the widening behind the profiled reception region also creates a form fit in this direction.

The form-fit design in the reception region of the spherical clamp can be used for all attachment parts.

In order to simplify the installation of the elements of the upper hemisphere and their alignment, an element of a first hemisphere can be designed with a bulge in an edge region of the hemisphere, which extends into the edge region of the adjacent element of the other hemisphere, and the adjacent element of the other hemisphere can have a corresponding recess. It is therefore intended that an element of one hemisphere extends in its edge region, i.e. along the sphere contour, into the edge region of the other hemisphere and in particular into the element located there, which has a corresponding recess for this purpose. This region can be a pivot point for assembly, around which the element of the upper hemisphere can be swivelled into its end position. As the upper hemisphere is designed with the same elements as the lower hemisphere, there will be another similar combination with a bulge and recess in a reversed arrangement.

If the bulge is also formed with a protuberance and the recess of the other element has a corresponding receptacle, the protuberance on the bulge of one element can engage with the receptacle in the recess of the other element during assembly and thus provide additional support. This can be used in particular to secure the position, especially until all the elements have been screwed together. The protuberance can, for example, take the form of a nose or a pin-like elevation in the region of the bulge.

Alternatively or additionally, corresponding elevations and/or depressions can be formed along the equatorial surfaces of the hemispheres in order to realise a form fit between the hemispheres. This can also prevent the hemispheres from moving relative to each other or the elements from moving along the equatorial surfaces during installation. In the event of screw connections failing, this can also provide a certain residual safety.

In this embodiment, it is therefore provided that elevations and/or depressions are formed on the base surfaces of the hemispheres that form the equatorial surfaces, wherein an elevation on an element of one hemisphere is accompanied by a depression in the opposite element of the other hemisphere. When the elements are assembled, the elevation and depression engage and thus form the form fit.

The drill holes and screw holes for connecting the two hemispheres to each other are particularly suitable for this design. For example, an elevation can be formed in the region of the drilled hole in the direction of the other hemisphere and a depression in the region of the screw hole in the other hemisphere. The threaded bush there would then be recessed slightly deeper into the element. The advantage of this is that when the elements are assembled, the drill hole and screw hole are aligned on top of each other, respectively, and the screw can be inserted and screwed in quickly and easily.

To ensure that the screw heads of the screws for connecting the elements within a hemisphere or the hemispheres to each other do not protrude and pose a risk of injury, recesses should be formed starting from the surface of the spherical clamp in the direction of the screw connections. This should be understood to mean that in the region of an element in which a screw is to be inserted for connection to another element, a recess in the sense of a depression is formed in the direction of the screw hole so that the screw head is countersunk into it when screwing. It is therefore lower than the rest of the surface of the element, so that accidental getting caught on the screw head can be avoided. This also protects the screw from unauthorised access.

Yet another embodiment of the scaffolding system according to the invention provides that the elements for forming the hemispheres are designed as hollow bodies. In other words, they should not be provided as solid bodies, but should have cavities where this is sensible and technically possible with regard to the expected loads. The cavities do not have to be closed cavities; they can also be open in one or more directions. Designing the elements in this way can significantly reduce weight, which in turn allows for a more spacious and free design of playground installations and/or climbing frames.

The scaffolding system according to the invention should preferably be used for playground structures, playground elements and/or climbing frames. Playground structures and playground elements can also be summarised under the term playground installations. A variety of playground installations and/or climbing frames can be designed using inclined (and non-inclined) posts, the spherical clamps and attachment parts that are connected to the clamps or otherwise to the scaffolding system. By deviating from right-angled constructions, such playground installations and/or climbing frames appear more playful, more organic and stimulate the creativity of the users, i.e. the children. Places, figures or objects can also be modelled more easily and better if there is no restriction to a right-angled fastening or construction system.

The scaffolding system according to the invention proposes a solution for designing playground installations and/or climbing scaffolds with posts and clamps without being restricted to a rectangular system. It allows the posts to be inclined, while spherical clamps can be used to compensate for the angle of inclination, so that horizontally aligned receptacles can be provided for attachment parts of all kinds. This means that intermediate levels can be installed quickly and easily and are immediately aligned horizontally. Of course, such a clamp can also be attached to a non-inclined post and thus provide an inclined equatorial surface. The spherical clamps can also be mounted on inclined posts with a different angle. Any combination is possible and extends the design scope for the development of playground installations and/or climbing frames.

The various embodiments of the invention mentioned in this application can be advantageously combined with one another, unless otherwise stated in individual cases.

Figure 2:
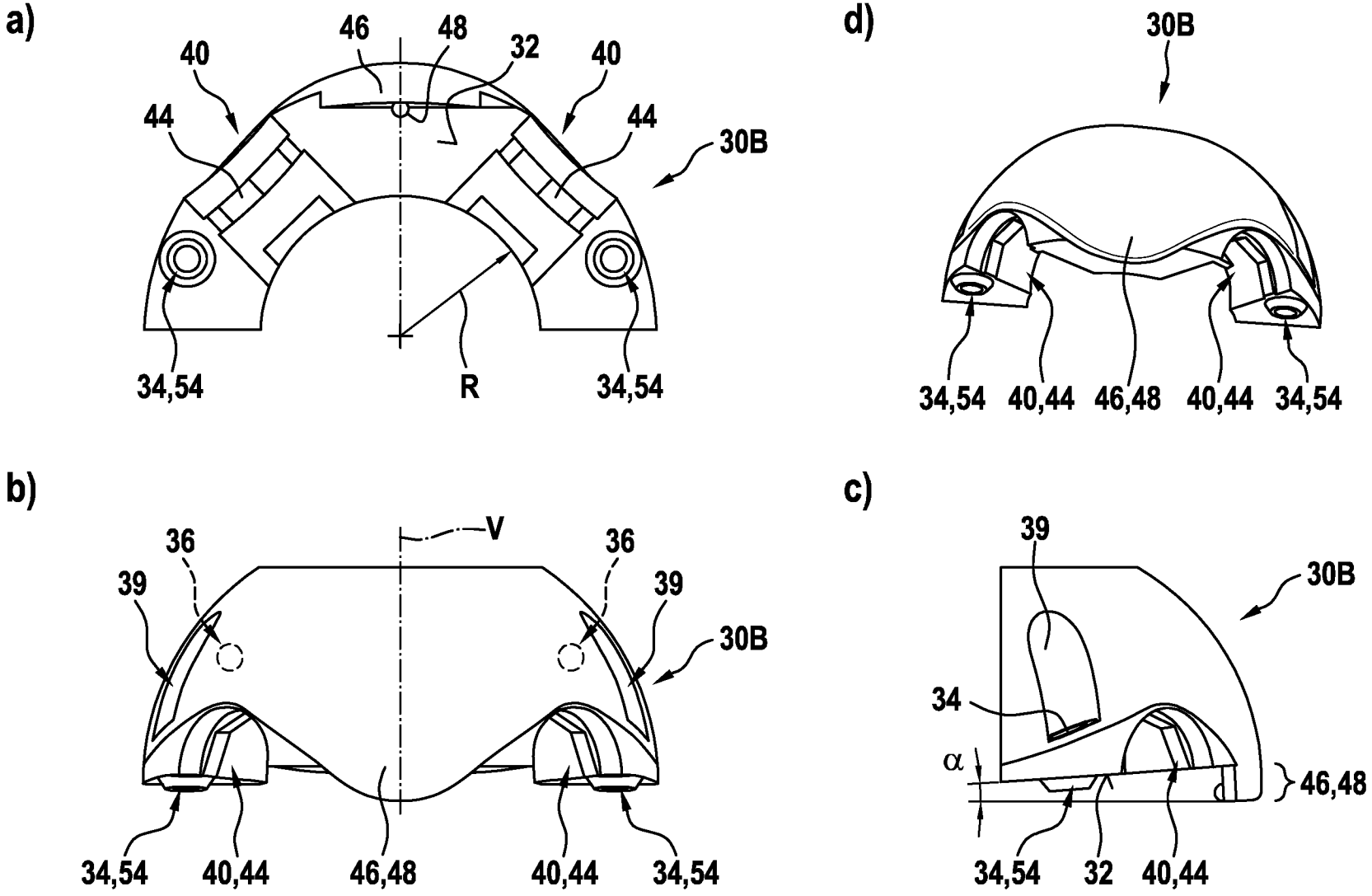
Figure 3:
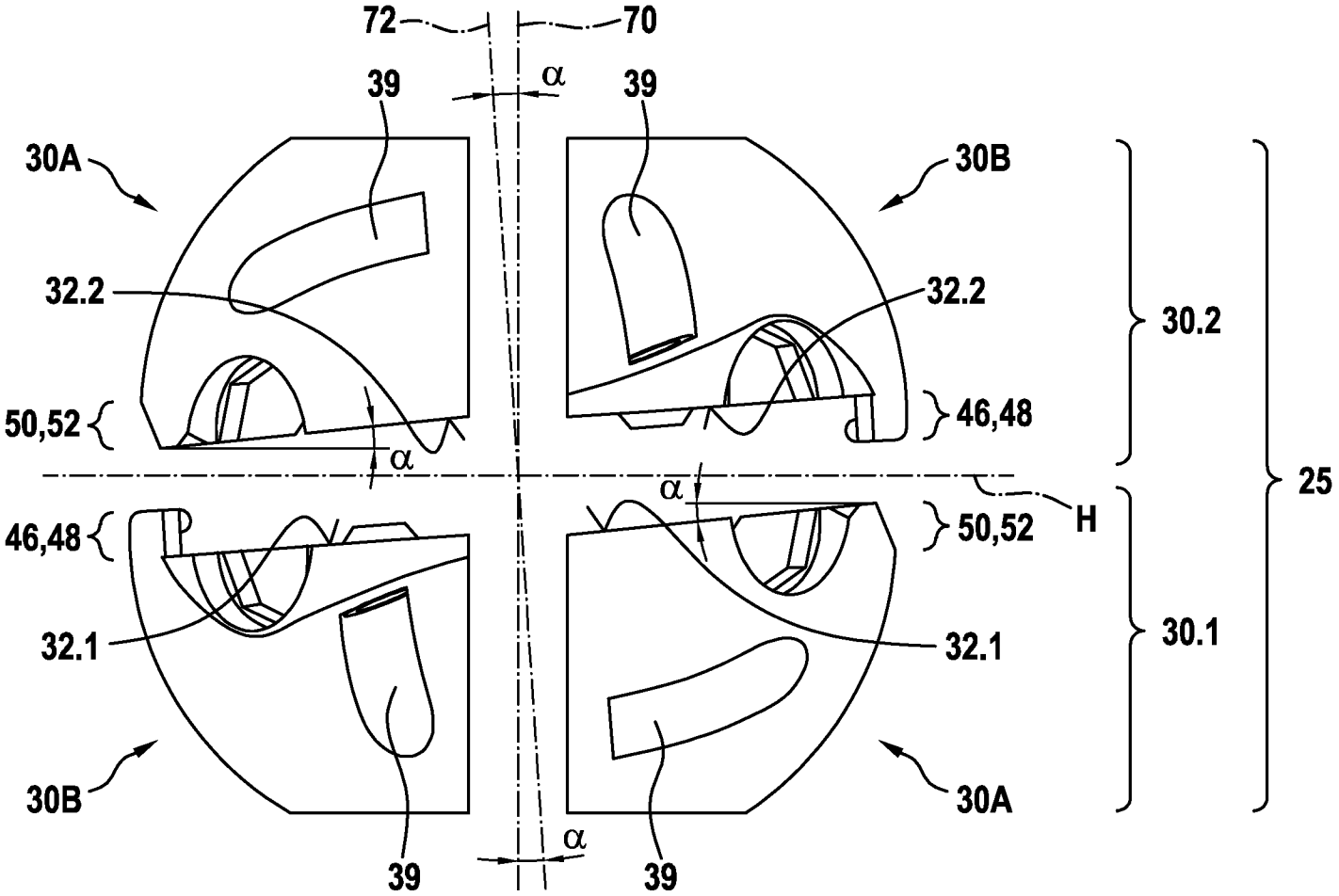
Figure 8:
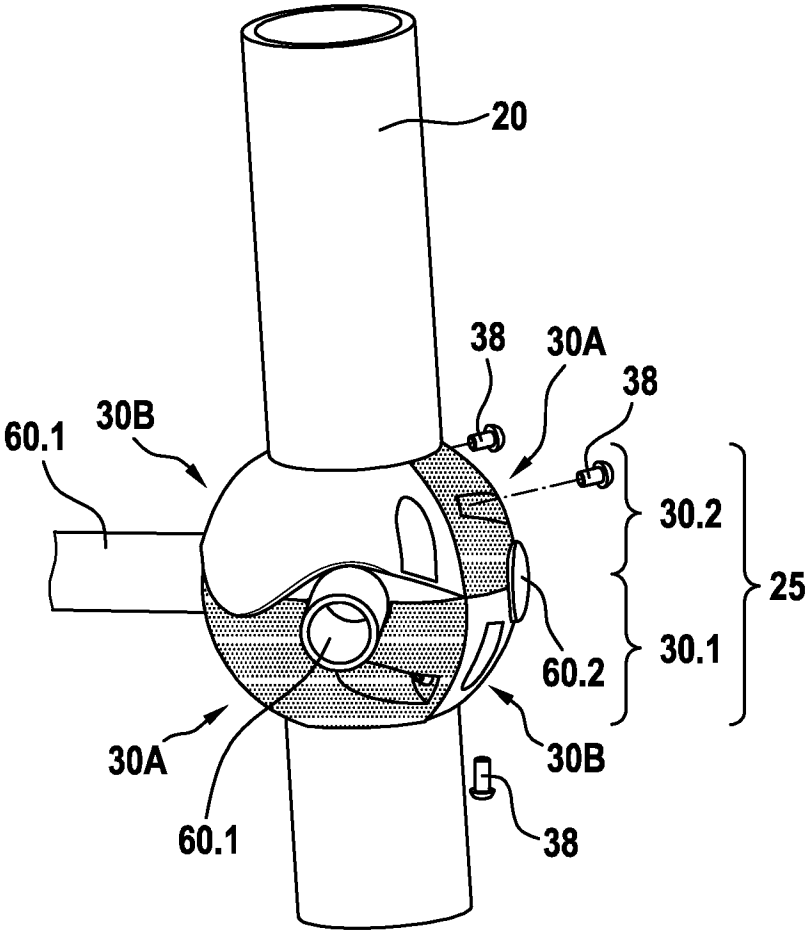
Figure 7:
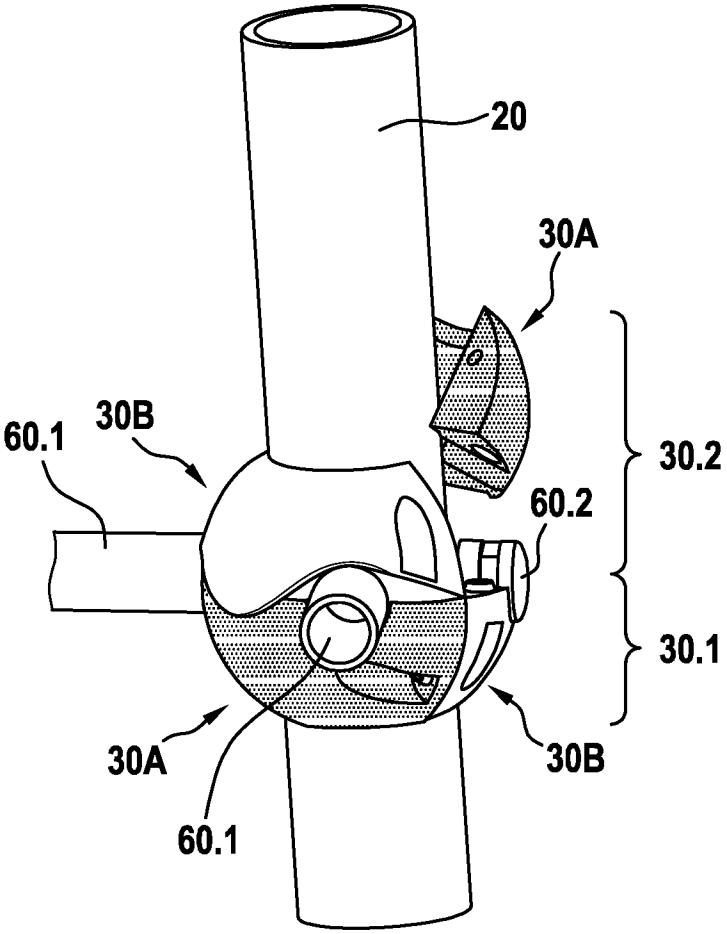
Figure 9:
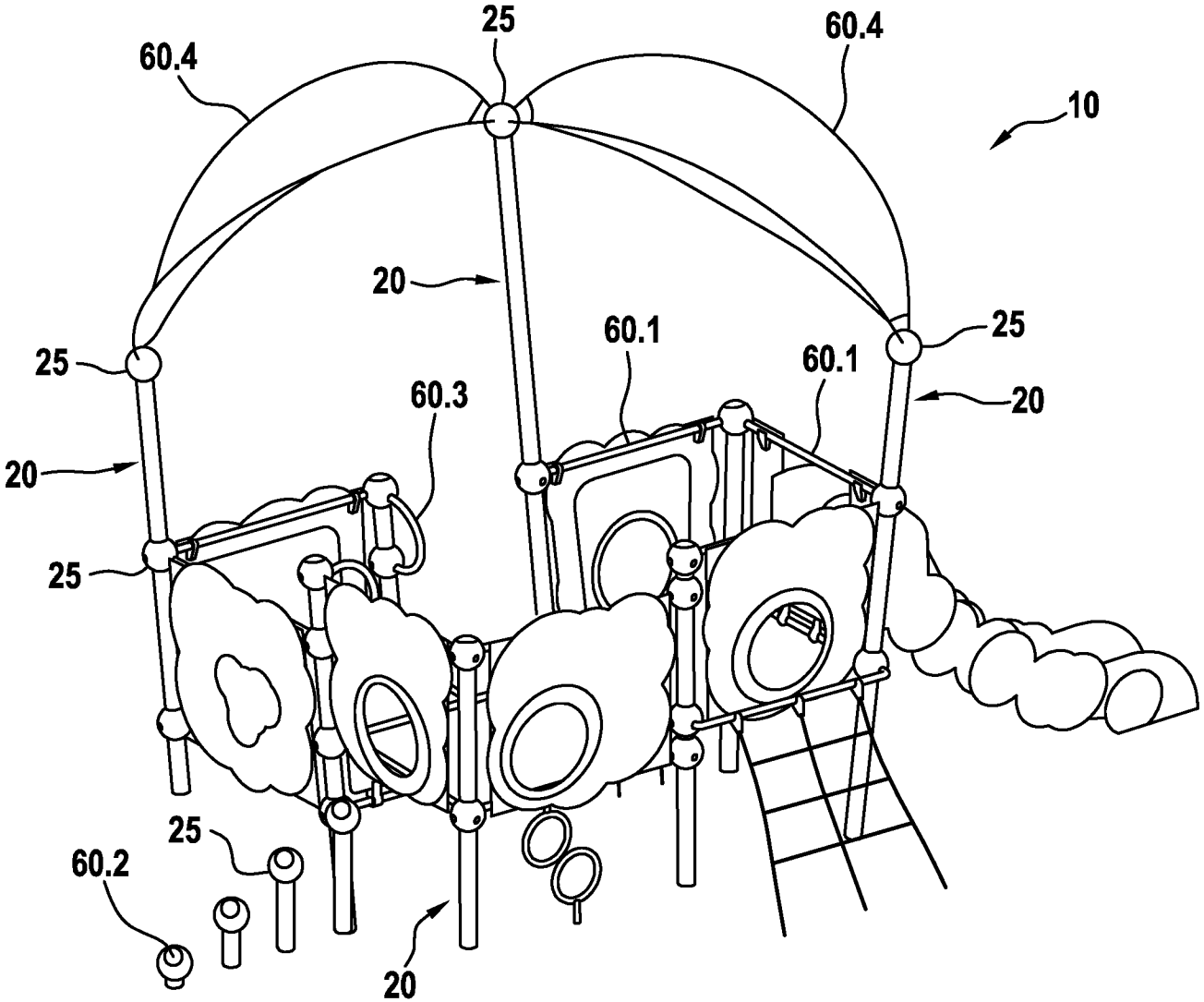
Figure 10:
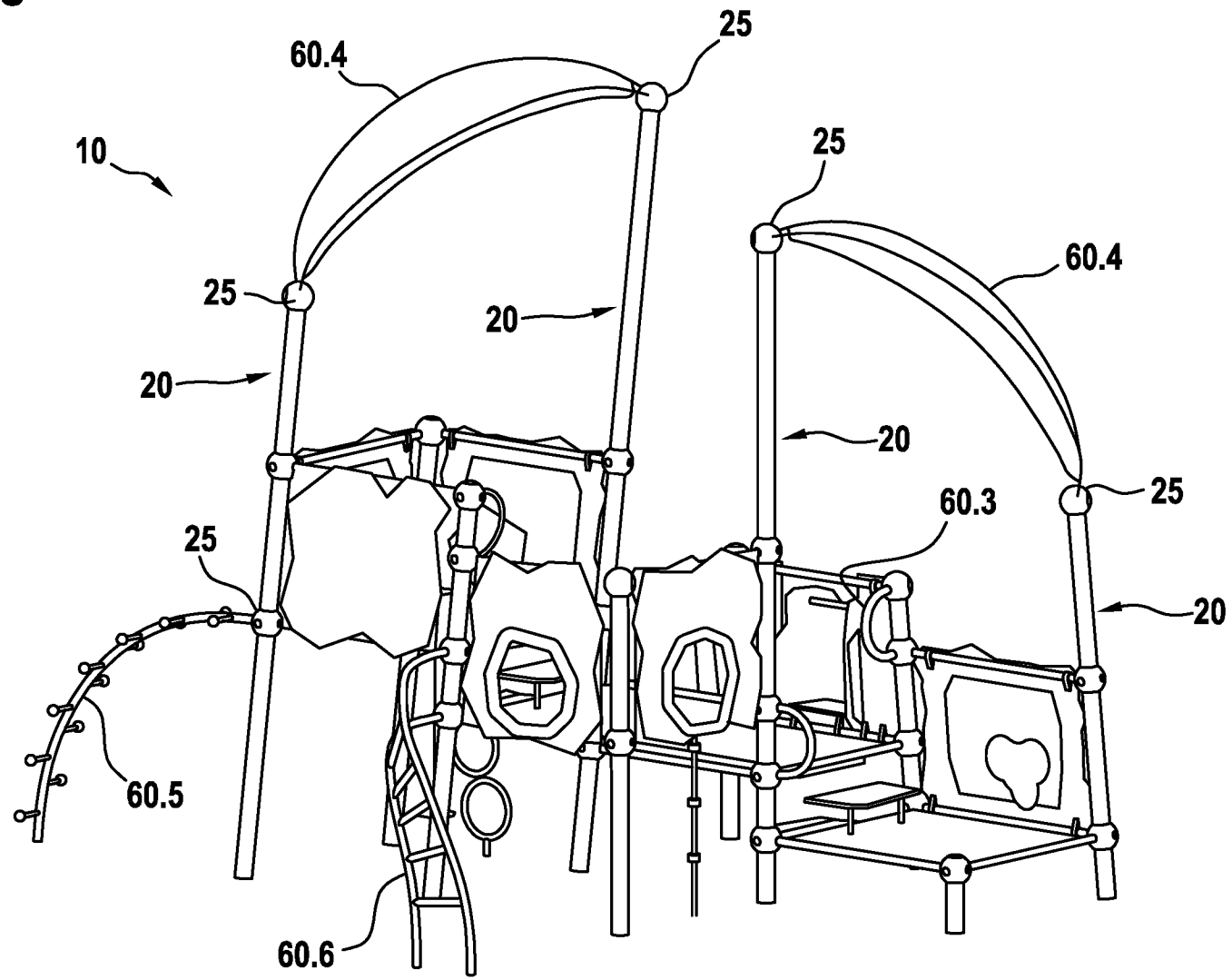
Figure 11:
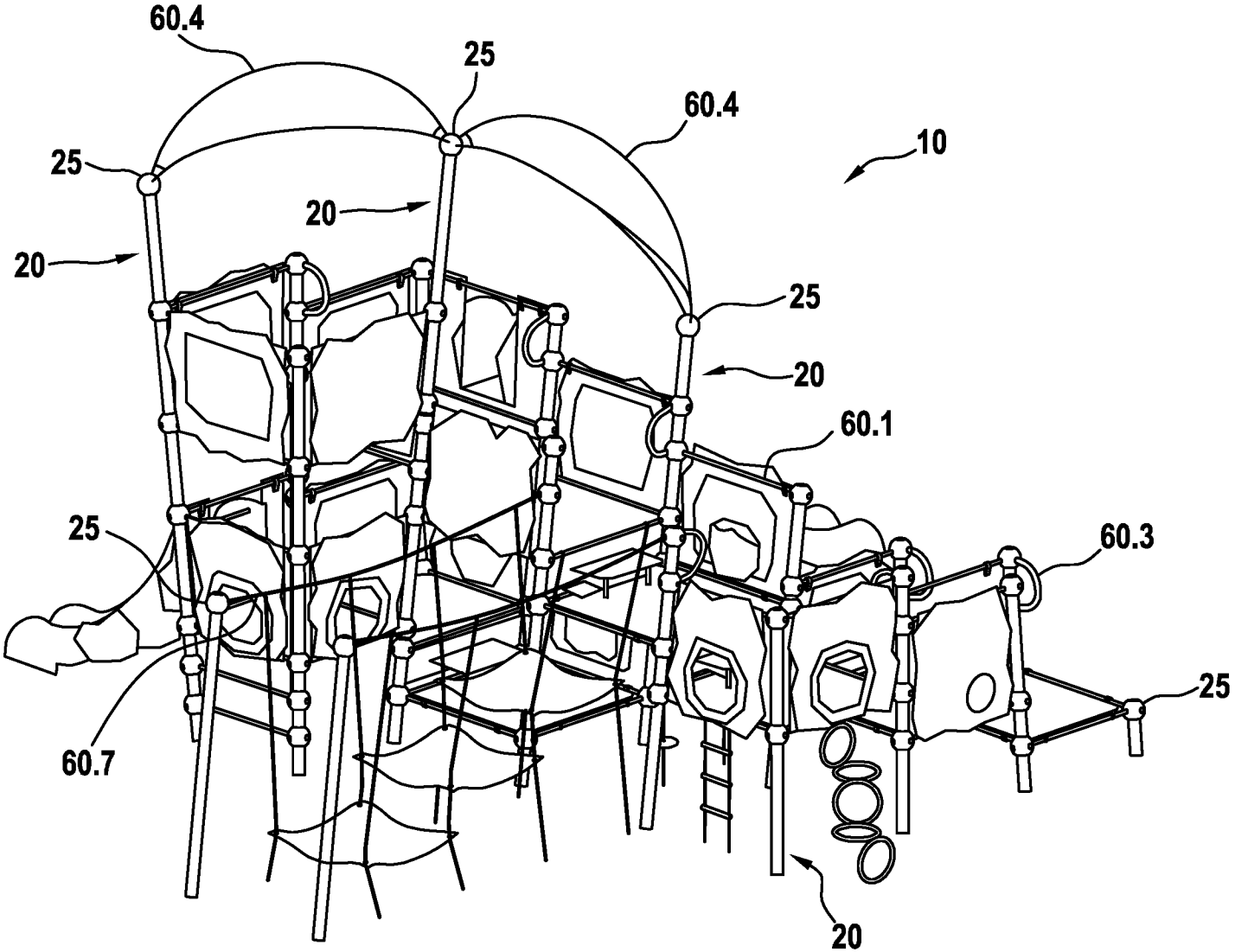

The invention is explained below in embodiments with reference to the associated drawings. They show:

FIGS. 1 and 2 exemplary designs of the elements for a hemisphere of a spherical clamp, FIG. 3 a view of the assembly of the elements from FIGS. 1 and 2 to form a spherical clamp, FIGS. 4 to 8 the assembly of a spherical clamp on an inclined post, and FIGS. 9 to 11 examples of playground installations with the scaffolding system according to the invention.

FIGS. 1 and 2 show elements 30A, 30B for forming a hemisphere 30 for a spherical clamp 25 of a scaffolding system 10 according to the invention with two elements within a hemisphere 30. Both figures are explained together. The design with two elements 30A, 30B in a hemisphere 30 is merely an exemplary embodiment.

The elements 30A, 30B are intended to be arranged on a post inclined by an angle $\alpha$. In both figures, a view from the direction of the equatorial surface 32 is shown in figure part a, lateral views are shown in figure parts b and c and a perspective view is shown in figure part d. After the description of the elements 30A, 30B, their assembly and use are described with reference to the other figures.

FIG. 1 therefore shows a first element 30A. It occupies approximately half of a hemisphere 30 and is modelled approximately on a spherical quarter. The same applies to element 30B in FIG. 2. Both elements 30A, 30B have a recess in the direction of the future vertical axis, which serves to accommodate the post. It is referred to with the radius R.

The elements 30A, 30B have screw holes 34 and threaded bushes 36 into which screws can be inserted, by means of which the two elements 30A, 30B can be screwed together and to the elements 30A, 30B of the other hemisphere 30. Element 30B in FIG. 2 has elevations 54 in the region of its screw holes 34, which are arranged on the equatorial surface 32 to be formed. Element 30A in FIG. 1 has depressions 56 in the region of the threaded bushes 36, which face the equatorial surface 32 to be formed. Both elements 30A, 30B together form a hemisphere 30.1 and, in the same combination, a second hemisphere 30.2, as will be shown in the following figures. If these hemispheres 30.1 and 30.2 are put together, an element 30A passes over an element 30B and an element 30B passes over an element 30A. The elevations 54 and depressions 56 just explained then interlock and form a form fit between the hemispheres 30.1 and 30.2.

To ensure that the necessary screws do not pose a risk of injury after the hemispheres 30.1 and 30.2 have been mounted in the scaffolding system, recesses 39 are formed starting from their surface in the direction of the screw connections, i.e. the screw holes 34, in which the screws are countersunk.

So that the spherical clamp 25 can accommodate attachment parts (not shown here) as intended, receptacles 40 are provided in each element 30A, 30B. They are arranged in a 90° grid in relation to the base surface of the hemispheres 30 to be formed. Each of the receptacles 40 has a profiling 44 which corresponds to a profiling on an attachment part in order to effect a form fit between the attachment part and element 30A, 30B of the spherical clamp 25. The receptacles 40 and thus also the profilings 44 are each formed half in an element 30A, 30B. The profiling 44 in each case represents a constriction in the receptacle 40. As an example, the profiling of the attachment parts should run around the attachment part as an octagonal circumferential ring (see also FIG. 5).

In order to facilitate installation and to effect a further form fit between the hemispheres 30.1 and 30.2, the element 30B has a bulge 46 in its edge region (FIG. 2), which protrudes in the direction of the element 30A of the other hemisphere and overlaps it there. Correspondingly, the element 30A has a recess 50 into which this bulge 46 can extend. This means that it is no longer possible for the hemispheres 30.1 and 30.2 to move relative to each other. The relative position of the two elements 30A, 30B in the two hemispheres 30.1 and 30.2 arranged one above the other is further fixed because the bulge 46 is formed with a protrusion or lug 48, which engages in a receptacle 52 of the recess 50 when the elements 30A, 30B are assembled.

In each of FIGS. 1*c* and 2*c*, the formation of the elements 30A, 30B to compensate for the inclined post around the angle α becomes clear: Instead of a surface perpendicular to the vertical axis V of the element 30A, 30B (in FIGS. 1*b* and 2*b*), the surfaces of the elements 30A, 30B, which form the equatorial surface 32, run inclined around the angle α.

The function and interaction of the elements 30A, 30B of a hemisphere are best illustrated in FIG. 3. There, the elements 30A and 30B are shown in a lateral view as they are arranged in relation to each other. The angle α is also designated here. As already explained, an element 30A and an element 30B form a hemisphere 30.1 or, in the same way, a hemisphere 30.2. Each hemisphere 30.1, 30.2 has an equatorial surface 32.1 or 32.2 which runs over both elements 30A, 30B. The elements 30A, 30B of a hemisphere 30.1, 30.2 each continue the inclination by the angle α so that a common plane is formed. If the hemispheres 30.1 and 30.2 are arranged on top of each other, they must be arranged rotated by 180° relative to each other (as shown in FIG. 3) so that the inclinations of the equatorial surfaces 32.1 and 32.2 allow them to lie flush against each other and form the spherical shape of the clamp 25. This also brings the screw holes 34 and threaded bushes 36 already described into the correct relative position, as well as the bulges 46 and recesses 50.

However, the representation of the elements 30A, 30B in FIG. 3 deviates from the installation position in that the vertical axis 70 shown there corresponds to the axis of the inclined post in the installation position, i.e. would be inclined by the angle α (referred to as axis 72), whereby the equatorial surfaces 32.1 and 32.2 are aligned horizontally, as provided for in accordance with the invention.

Figure 4:
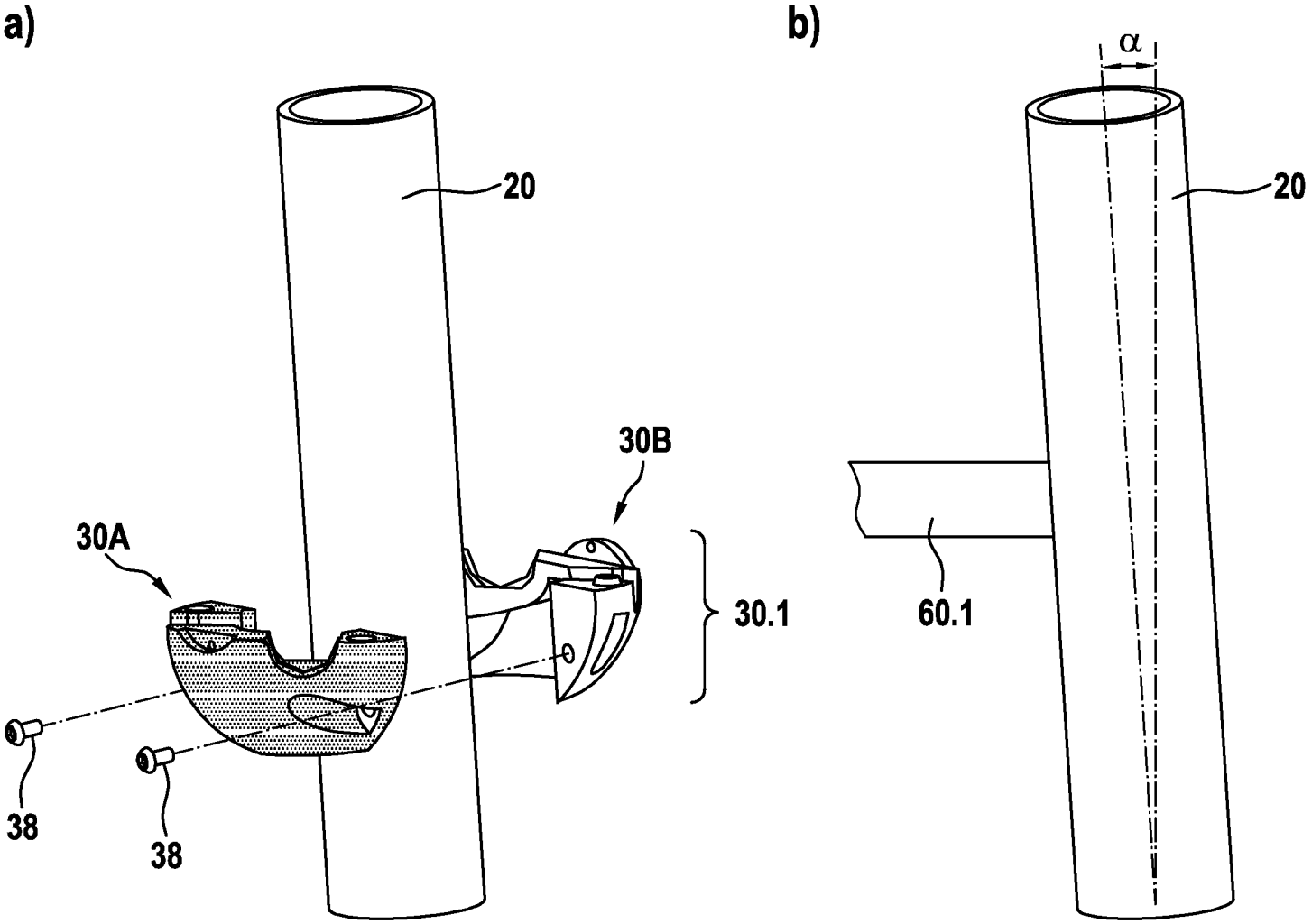

Only FIGS. 4 to 8, which describe the actual assembly or one possibility of the assembly, are explained below. FIG. 4*a* shows a post 20 that is inclined by an angle α, as illustrated in FIG. 4*b*. The angle α is intended to be 5° (degrees) as an example. The post 20 is formed as a tube with a round cross-section.

Elements 30A and 30B of the lower hemisphere 30.1 are to be attached to the post 20. As can be seen from FIG. 4*a*, some of these are designed as hollow bodies in order to reduce weight. They also have different colours in order to distinguish them quickly and reliably from one another, so that installation is simplified and accelerated.

The elements 30A, 30B are brought up to the post 20 individually until they surround it in a ring and then screwed together with screws 38. The screw holes 34 and threaded bushes 36 described above are used for this purpose. This also creates a clamping effect of the lower hemisphere 30.1 on the post 20. The equatorial surface 32 formed by the elements 30A, 30B is now aligned horizontally due to the formation of the elements 30A, 30B, as previously explained.

Figure 5:
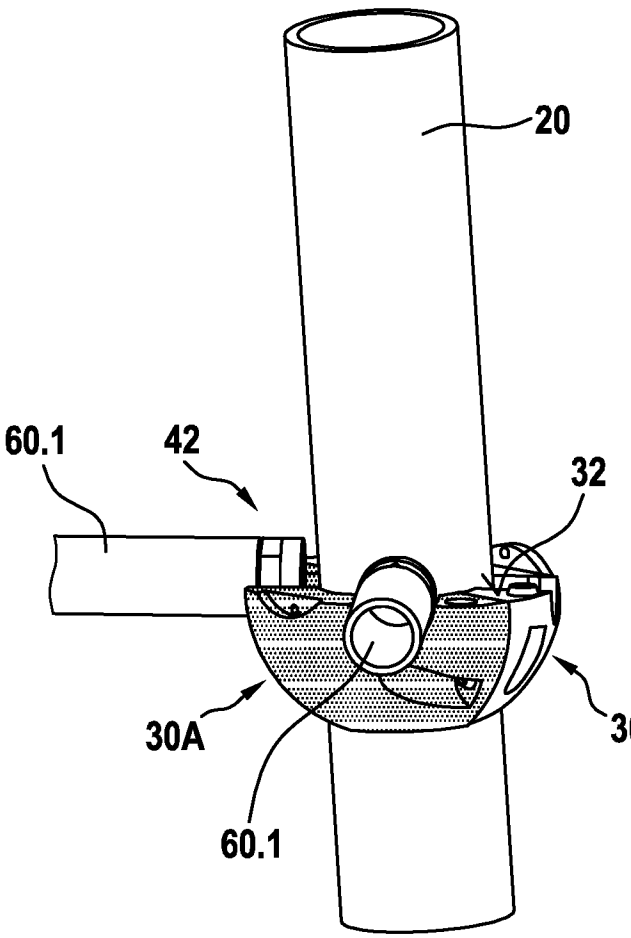
Figure 5:
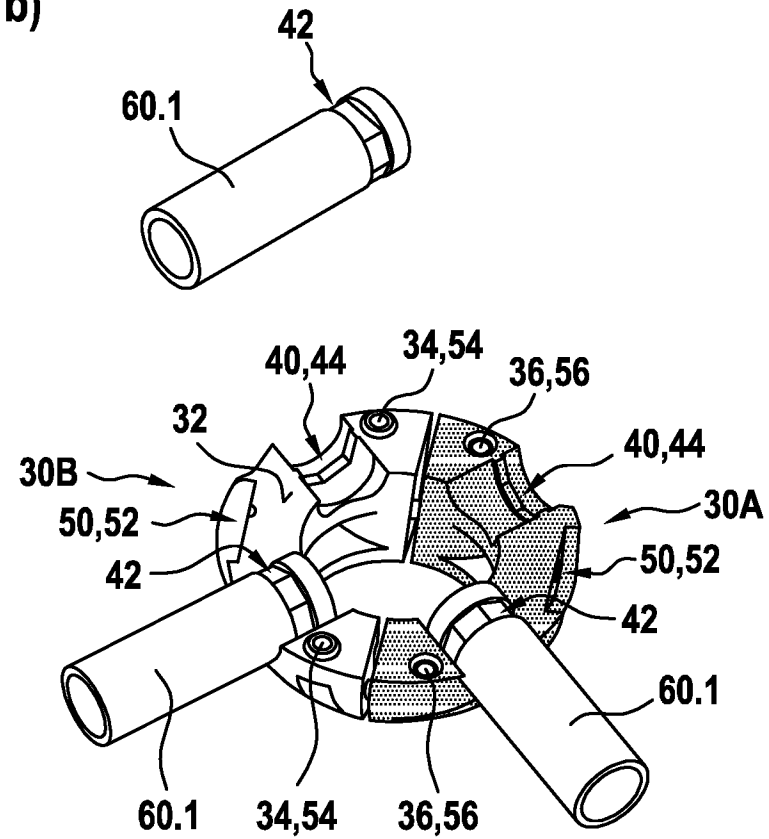

In FIG. 5, attachment parts 60 are inserted into the receptacles 40 of the element 30A provided for this purpose. In this figure, one tube 60.1 is shown in each case, which is intended, for example, to serve as a horizontal connection between two posts. The tubes 60.1 have profilings 42 in the form of an octagonal ring in their end regions, which correspond to the profilings 44 of the receptacles 40. The end of the tubes 60.1 no longer has any profiling. Since the profilings 42 form a narrowing of the cross-section and the tubes 60.1 then have a wider cross-section again without profilings, they cannot be pulled out of the receptacles along their longitudinal axis. The profilings 42, 44 prevent the tubes 60.1 from twisting and slipping in the receptacles 40 and offer the possibility of pre-alignment of attachment parts 60 until the element of the upper hemisphere can be attached and fixed. The profilings 42, 44 shown here can be used in the same way for other attachment parts 60.

Figure 6:
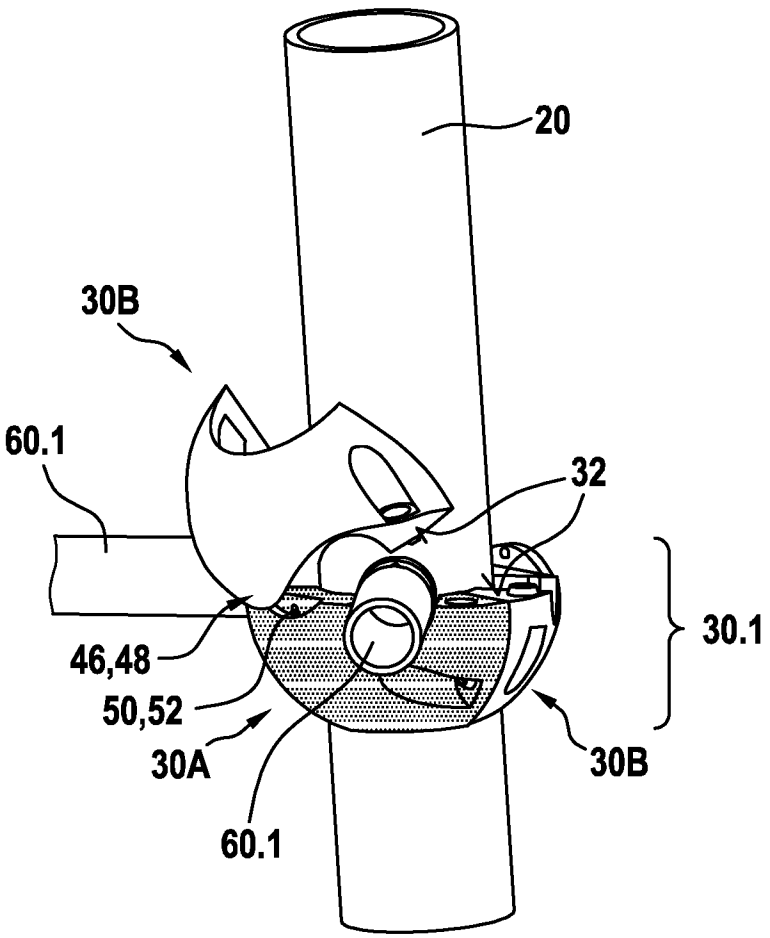
Figure 6:
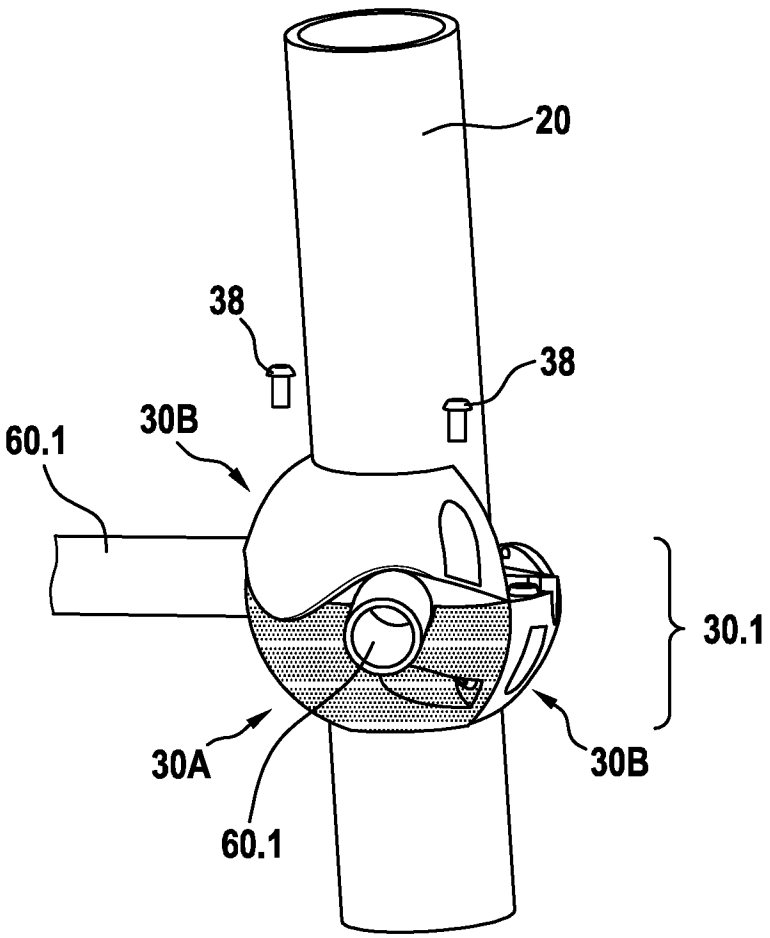

The installation of the upper element 30B is shown in FIG. 6. FIG. 6*a* clearly shows that the element 30B of the upper hemisphere 30.2 is attached with its bulge 46 to the recess 50 of the element 30A of the lower hemisphere 30.1 and rotated around it in the direction of the post 20. In the process, the protuberance 48 also comes into engagement with the receptacle 52. The tubes 60.1, or other attachment parts, are now fixed in position. As can be seen in FIG. 6*b*, the upper element 30B and the lower element 30A are connected to each other using screws 38. Now closure plugs 60.2 or other attachment parts 60 can be inserted into the receptacles 40 of the lower element 30B (FIG. 7) and the upper element 30A can be mounted. This is screwed to both the element 30B of the same hemisphere 30.2 and the element 30B of the lower hemisphere 30.1 (FIG. 8). Both hemispheres 30.1 and 30.2 are now completely secured in their position and thus form the spherical clamp 25 with horizontally connected attachment parts 60.

The use of the spherical clamp 25 and the entire scaffolding system 10 according to the invention is shown by way of example in FIGS. 9 to 11. The figures are described together and the differences are pointed out in particular. Reference numerals are assigned and explained in each case only to relevant elements, but not each element is designated individually.

All three FIGS. 9 to 11 show a playground installation with climbing and play elements realised with the scaffolding system 10. The posts 20 are mostly inclined. A large number of spherical clamps 25 are arranged on the posts 20, to which attachment parts 60 of all kinds are attached. In FIG. 9, for example, awnings 60.4 are each inserted and attached to two receptacles of a clamp 25, respectively. Handles 60.3 are arranged between two clamps 25 and facilitate access to the climbing frame. Tubes 60.1 connect clamps 25 horizontally and are used to attach panelling elements and decorative elements that cannot be attached to a clamp 25. Some clamps 25 are also only used decoratively with plugs 60.2.

In FIG. 10, clamps 25 form starting points for climbing aids 60.5 and ladders 60.6. FIG. 11 also shows the connection of ropes 60.7 to the spherical clamps 25.

REFERENCE NUMERAL

10 Scaffolding system
20 Post
25 Spherical clamp

30 Hemisphere
30 Element of one hemisphere
30 Element of one hemisphere
32 Equatorial surface
34 Screw hole
36 Threaded bush
38 Screw
39 Recess for screw
40 Receptacle
42 Profiling on the attachment part
44 Profiling in the element
46 Bulge
48 Protuberance in bulge
50 Recess
52 Receptacle in recess
54 Elevation on the equatorial surface
56 Depression in the equatorial surface
60 Attachment part
70 axis
72 axis
α Inclination angle of the post
R Radius (inner radius)
V Vertical axis

The invention claimed is:

1. A scaffolding system with posts and spherical clamps, in which an associated post is arranged inclined at an angle and at least one spherical clamp is arranged on the associated post and wherein each spherical clamp comprises two hemispheres, wherein each hemisphere of the two hemispheres is formed from elements, which differ from one another within each hemisphere, the elements of each hemisphere surround the associated post, equatorial surfaces formed by the elements of each hemisphere deviate from a plane perpendicular to the associated post at the angle at which the associated post is inclined such that the equatorial surfaces of the two hemispheres are aligned horizontally, the elements of each hemisphere are screwed together such that a clamping effect results between the two hemispheres and the associated post, the two hemispheres are screwed together, and each element of each hemisphere has receptacles in a region of the respective equatorial surfaces that are configured for the insertion of at least one attachment part.

2. The scaffolding system of claim 1, wherein the associated post has a round cross-section and the two hemispheres of the at least one spherical clamp are arranged on the associated post such that each hemisphere surrounds the associated post in an annular manner.

3. The scaffolding system of claim 1, wherein the associated post is arranged at an angle in the range from 2° to 12°.

4. The scaffolding system of claim 1, wherein the elements of at least one hemisphere of the two hemispheres have different colours.

5. The scaffolding system of claim 1, further comprising:

the at least one attachment part selected from the group consisting of a tube, a handle, a decorative element, a sunshade, a rope, and a closure plug.

6. The scaffolding system of claim 1, wherein the receptacles are each arranged offset by 90° along the equatorial surfaces.

7. The scaffolding system of claim 1, wherein the at least one attachment part, insertable into the receptacles of the at least one spherical clamp, is formed with a profiling, and the receptacles of the at least one spherical clamp are formed with a corresponding profiling in order to provide a form fit between the at least one attachment part and the respective receptacle.

8. The scaffolding system of claim 1, wherein an element of a first hemisphere of the two hemispheres is formed with a bulge in an edge region of the first hemisphere, which extends into an edge region of an adjacent element of a second hemisphere of the two hemispheres, wherein a protuberance is formed on the bulge, and the adjacent element of the second hemisphere of the two hemispheres is formed with a corresponding recess, wherein the corresponding recess comprises a receptacle configured to correspond with the protuberance.

9. The scaffolding system of claim 1, further comprising:

elevations and/or depressions corresponding to one another formed along the equatorial surfaces of the two hemispheres and configured to provide a form fit between the two hemispheres.

10. The scaffolding system of claim 1, wherein, starting from a surface of the at least one spherical clamp, recesses are formed in the direction of screw connections.

11. The scaffolding system of claim 1, wherein the elements for forming the two hemispheres are designed as hollow bodies.

* * * * *